US011473175B2

(12) United States Patent
Shin et al.

(10) Patent No.: US 11,473,175 B2
(45) Date of Patent: Oct. 18, 2022

(54) METHOD FOR PRODUCING MAGNETIC POWDER AND MAGNETIC POWDER

(71) Applicant: LG Chem, Ltd., Seoul (KR)

(72) Inventors: Eunjeong Shin, Daejeon (KR); Juneho In, Daejeon (KR); Jinhyeok Choe, Daejeon (KR); Sangwoo Kim, Daejeon (KR); Soon Jae Kwon, Daejeon (KR); Hyounsoo Uh, Daejeon (KR); Ikjin Choi, Daejeon (KR); Ingyu Kim, Daejeon (KR)

(73) Assignee: LG Chem, Ltd.

( * ) Notice: Subject to any disclaimer, the term of this patent is extended or adjusted under 35 U.S.C. 154(b) by 329 days.

(21) Appl. No.: 16/643,077

(22) PCT Filed: Nov. 28, 2018

(86) PCT No.: PCT/KR2018/014846
§ 371 (c)(1),
(2) Date: Feb. 28, 2020

(87) PCT Pub. No.: WO2019/107926
PCT Pub. Date: Jun. 6, 2019

(65) Prior Publication Data

US 2020/0199718 A1 Jun. 25, 2020

(30) Foreign Application Priority Data

Nov. 28, 2017 (KR) ..... 10-2017-0160639
Nov. 27, 2018 (KR) ..... 10-2018-0148565

(51) Int. Cl.

| | |
|---|---|
| ***C22C 33/02*** | (2006.01) |
| ***C22C 38/00*** | (2006.01) |
| ***H01F 1/057*** | (2006.01) |
| ***B22F 1/142*** | (2022.01) |
| ***B22F 1/145*** | (2022.01) |
| ***B22F 9/20*** | (2006.01) |

(52) U.S. Cl.
CPC ..... *C22C 33/02* (2013.01); *B22F 1/142* (2022.01); *B22F 1/145* (2022.01); *B22F 9/20* (2013.01); *C22C 38/005* (2013.01); *H01F 1/0571* (2013.01); *C22C 2202/02* (2013.01)

(58) Field of Classification Search
CPC ..... C22C 33/02
See application file for complete search history.

(56) References Cited

U.S. PATENT DOCUMENTS

| | | | | |
|---|---|---|---|---|
| 4,578,242 | A | 3/1986 | Sharma | |
| 4,681,623 | A * | 7/1987 | Okajima | C22B 5/04 75/351 |
| 4,837,109 | A | 6/1989 | Tokunaga et al. | |
| 4,881,985 | A | 11/1989 | Brewer et al. | |
| 6,051,047 | A | 4/2000 | Zhou et al. | |
| 7,199,690 | B2 | 4/2007 | Hidaka et al. | |
| 2002/0144754 | A1 | 10/2002 | Tokoro et al. | |
| 2016/0322135 | A1 | 11/2016 | Eguchi et al. | |

FOREIGN PATENT DOCUMENTS

| | | | |
|---|---|---|---|
| CN | 1261717 | A | 8/2000 |
| CN | 1424164 | A | 6/2003 |
| CN | 105081338 | A | 11/2015 |
| CN | 103849809 | B | 3/2016 |
| CN | 106816250 | A | 6/2017 |
| CN | 107056270 | A | 8/2017 |
| EP | 1005050 | A2 | 5/2000 |
| JP | S61295308 | A | 12/1986 |
| JP | S63057722 | A | 3/1988 |
| JP | H02302013 | A | 12/1990 |
| JP | H06006727 | B2 | 1/1994 |
| JP | H09186010 | A | 7/1997 |
| JP | 200030919 | A | 1/2000 |
| JP | 2000223306 | A | 8/2000 |
| JP | 200212921 | A | 1/2002 |
| JP | 3762912 | B2 | 4/2006 |
| JP | 2006239482 | A | 9/2006 |
| JP | 2012142388 | A | 7/2012 |
| JP | 2013083001 | A | 5/2013 |
| JP | 201521802 | A | 2/2015 |
| JP | 2016213378 | A | 12/2016 |
| KR | 900006193 | B1 | 8/1990 |
| KR | 910001582 | B1 | 3/1991 |
| KR | 19980086499 | A | 12/1998 |
| KR | 101354138 | B1 | 1/2014 |
| WO | 2015068681 | A1 | 5/2015 |

OTHER PUBLICATIONS

Chinese Search Report for Application No. 201880059041.4, dated Nov. 3, 2020, pp. 1-4.
Ram et al., Synthesis and magnetic properties of SrZn2-W type hexagonal ferrites using a partial 2Zn2+→Li+Fe3+ substitution: a new series of permanent magnets materials, Journal of Magnetism and Magnetic Materials, Received Dec. 12, 1990, pp. 133-144, vol. 99.
Sun Ai-Zhi, et al., Research and Development Status of Anisotropic Bonded Rare Earth Permanent Magnetic Materials, J. Magn. Mater. and Devices, Dec. 2005, pp. 7-12, vol. 36 No. 6. (English Abstract only).
Extended European Search Report including Written Opinion for Application No. EP18883660.5 dated Jul. 2020, 9 pgs.
International Search Report from Application No. PCT/KR2018/014846 dated May 24, 2019, 2 pages.

* cited by examiner

*Primary Examiner* — Christopher S Kessler
(74) *Attorney, Agent, or Firm* — Lerner, David, Littenberg, Krumholz & Mentlik, LLP

(57) ABSTRACT

A method for producing a magnetic powder includes the steps of: mixing neodymium oxide, boron, and iron to prepare a first mixture; adding and mixing calcium to the first mixture to prepare a second mixture; mixing an alkali metal with the second mixture to prepare a third mixture; and placing a carbon sheet on the third mixture, placing silica sand ($SiO_2$ sand) thereon, and then heating the same to a temperature of 800° C. to 1100° C.

10 Claims, 8 Drawing Sheets

METHOD FOR PRODUCING MAGNETIC POWDER AND MAGNETIC POWDER

CROSS-REFERENCE TO RELATED APPLICATION

This application is a national phase entry under 35 U.S.C. § 371 of International Application No. PCT/KR2018/014846, filed Nov. 28, 2018, which claims priority to Korean Patent Application No. 10-2017-0160639 filed Nov. 28, 2017, and Korean Patent Application No. 10-2018-0148565 filed Nov. 27, 2018, the entire contents of which are incorporated herein by reference.

TECHNICAL FIELD

The present invention relates to a method for producing a magnetic powder and a magnetic powder. More particularly, the present invention relates to a method for producing a $Nd_2Fe_{14}B$-based alloy powder and a $Nd_2Fe_{14}B$-based alloy powder.

Background Art

A NdFeB-based magnet is a permanent magnet having a composition of $Nd_2Fe_{14}B$ which is a compound of Nd which is a rare earth element, iron and boron (B), and has been used as a general-purpose permanent magnet for 30 years since it was developed in 1983. The NdFeB-based magnet is used in various fields such as electronic information, an automobile industry, medical appliances, energy, and traffic. Particularly, for catching up with recent trends of weight lightening and miniaturization, the NdFeB-based magnet is used for products such as machine tools, electronic information appliances, electronic products for home appliances, mobile phones, motors for robots, wind power generators, small motors for automobiles, and drive motors.

As a general method for producing a NdFeB-based magnet, a strip/mold casting or melt spinning method based on magnetic powder electrometallurgy is known. First, in the strip/mold casting method, a metal such as Nd, iron, and boron (B) is melted by heating to prepare an ingot, crystal grain particles are coarse-ground, and microparticles are prepared by a micronizing process. These processes are repeated to obtain a powder, which is subjected to pressing and sintering under a magnetic field to prepare an anisotropic sintered magnet.

In addition, in the melt spinning method, metal elements are melted and then poured into a wheel rotating at a high speed for quenching, and after jet milling grinding, the resultant is blended with a polymer to form a bond magnet or is pressed to manufacture a magnet.

However, these methods all have problems that a grinding process is essentially required and the grinding process takes a long time, and a process of coating a surface of powder is required after grinding.

The above information disclosed in this Background section is only for enhancement of understanding of the background of the invention and therefore it may contain information that does not form the prior art that is already known in this country to a person of ordinary skill in the art.

DISCLOSURE

Technical Problem

The present invention has been made in an effort to provide a method for producing a magnetic powder having advantages of omitting a grinding process and shortening a reaction time, and a magnetic powder produced by the method. More specifically, the present invention has been made in an effort to provide a method for producing a $Nd_2Fe_{14}B$-based alloy powder and a $Nd_2Fe_{14}B$-based alloy powder including anisotropic crystal grains.

Technical Solution

An exemplary embodiment of the present invention provides a method for producing a magnetic powder including: mixing neodymium oxide, boron, and iron to prepare a first mixture; adding calcium to the first mixture and mixing them to prepare a second mixture; mixing an alkali metal with the second mixture to prepare a third mixture; and placing a carbon sheet on the third mixture, placing silica sand ($SiO_2$ sand) thereon, and then heating the mixture at a temperature of 800° C. to 1100° C.

The alkali metal may be one or more selected from the group consisting of Li, Na, K, Rb, and Cs.

In the mixing of an alkali metal with the second mixture to prepare a third mixture, a content of the alkali metal may be 1 wt % to 20 wt %.

The produced magnetic powder may be $Nd_2Fe_4B$.

In the heating of the third mixture at a temperature of 800° C. to 1100° C., a heating time may be 10 minutes to 6 hours.

In the mixing of neodymium oxide, boron, and iron to prepare a first mixture, the first mixture may further include a metal fluoride.

The metal fluoride may be one or more metal fluorides selected from the group consisting of alkali metals, alkaline-earth metals, and transition metal fluorides.

The metal fluoride may include one or more metal fluorides selected from the group consisting of $CaF_2$, LiF, $AlF_3$, $CoF_2$, $CuF_2$, $CrF_3$, $FeF_2$, $NiF_2$, $GaF_3$, and $ZrF_4$.

In the mixing of neodymium oxide, boron, and iron to prepare a first mixture, one or more selected from the group consisting of Group 1 elements, Group 2 elements, and transition metals may be further included.

The produced magnetic powder may include anisotropic crystal grains.

Another embodiment of the present invention provides magnetic powder produced by mixing neodymium oxide, boron, and iron to prepare a first mixture; adding calcium to the first mixture and mixing them to prepare a second mixture; mixing an alkali metal with the second mixture to prepare a third mixture; and placing a carbon sheet on the third mixture, placing silica sand ($SiO_2$ sand) thereon, and then heating the mixture at a temperature of 800° C. to 1100° C.

The magnetic powder may include anisotropic crystal grains.

Advantageous Effects

As described above, in the method for producing magnetic powder according to the present exemplary embodiment, a grinding process may be omitted and a reaction time is shortened, and thus, the method for producing a magnetic powder is economical. In addition, the magnetic powder according to the present exemplary embodiment may include anisotropic crystal grains.

MODE FOR INVENTION

Figure 1:
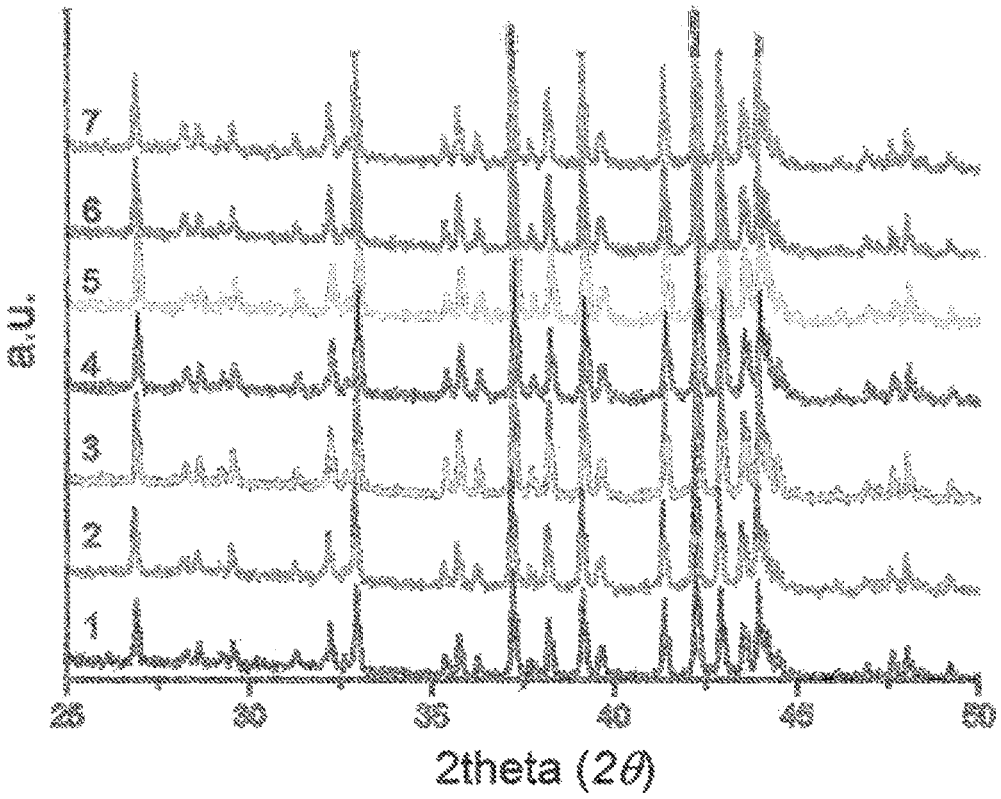
FIG. 1 shows XRD patterns of magnetic powders produced in Examples 1 to 7 of the present invention.

Hereinafter, a method for producing a magnetic powder according to an exemplary embodiment of the present disclosure will be described in detail. The method for producing a magnetic powder according to the present exemplary embodiment may be a method for producing a $Nd_2Fe_{14}B$ magnetic powder. That is, the method for producing a magnetic powder according to the present exemplary embodiment may be a method for producing a $Nd_2Fe_{14}B$-based alloy powder. The $Nd_2Fe_{14}B$ alloy powder is a permanent magnet and may be referred to as a neodymium magnet.

A method for producing a magnetic powder according to an exemplary embodiment of the present invention includes: mixing neodymium oxide, boron, and iron to prepare a first mixture; adding calcium to the first mixture and mixing them to prepare a second mixture; mixing an alkali metal with the second mixture to prepare a third mixture; and placing a carbon sheet on the third mixture, placing silica sand ($SiO_2$ sand) thereon, and then heating the mixture at a temperature of 800° C. to 1100° C.

The production method is a method of mixing raw materials such as neodymium oxide, boron, and iron, and reducing and diffusing the raw materials at a temperature of 800° C. to 1100° C. to form a $Nd_2Fe_{14}B$ alloy powder. Specifically, a mole ratio of neodymium oxide, boron, and iron in the mixture of neodymium oxide, boron, and iron may be between 1:14:1 and 1.5:14:1. Neodymium oxide, boron, and iron are raw materials for producing a $Nd_2Fe_{14}B$ magnetic powder, and when they satisfy the mole ratio, a $Nd_2Fe_{14}B$ alloy powder may be produced at a high yield. When the mole ratio is 1:14:1 or less, there may be a problem that formation of the composition of a $Nd_2Fe_{14}B$ main phase is failed or a Nd-rich grain boundary phase is not formed, and when the mole ratio is 1.5:14:1 or more, there may be a problem that reduced Nd remains due to an excessive amount of Nd and Nd remaining in a later-stage treatment process changes into Nd $(OH)_3$ or $NdH_2$.

In the step of mixing neodymium oxide, boron, and iron to prepare a first mixture, a step of mixing a metal fluoride may be further included. Here, a content of the fluoride may be 0.1 to 0.2 mol %, based on the entire first mixture. The metal fluoride may be one or more selected from the group consisting of fluorides of alkali metals, alkaline-earth metals, transition metals, and other metals Specifically, the metal fluoride may be one or more metal fluorides selected from the group consisting of $CaF_2$, LiF, $AlF_3$, $CoF_2$, $CuF_2$, $CrF_3$, $FeF_2$, $NiF_2$, $GaF_3$, and $ZrF_4$.

In addition, in the step of mixing neodymium oxide, boron, and iron to prepare a first mixture, the first mixture may further include one or more selected from the group consisting of Group 1 elements, Group 2 elements, and transition metals. As an example, copper or aluminum may be further added.

Next, calcium is added to the first mixture and mixed to prepare a second mixture. Here, the calcium may be a reducing agent.

An alkali metal is mixed with the second mixture to prepare a third mixture. The alkali metal may be one or more selected from the group consisting of Li, Na, K, Rb, and Cs. The alkali metal induces formation of anisotropic crystal grains inside a sintered magnet when the magnetic powder is sintered. Accordingly, magnetic crystal anisotropy of the sintered magnet may be optimized. When the magnetic powder is produced by a reduction-diffusion method in the state of not containing an alkali metal, the thus-produced magnetic powder has an irregular or isotropic shape. Accordingly, it is difficult to induce anisotropic crystal grains inside the sintered magnet, which acts as a limitation on optimizing the magnetic crystal anisotropy of the sintered magnet. However, the method for producing a magnetic powder according to the present exemplary embodiment may induce the anisotropic crystal grains of a magnetic powder by the alkali metal and control particle size and agglomeration.

In addition, agglomeration of a Fe powder occurs locally due to limitation of dry mixing at the time of synthesis of $Nd_2O_3$, B, and Fe powder which are raw materials. In addition, agglomeration and particle growth occur due to atom transfer between Fe powders at the time of synthesis at a high temperature. However, when the alkali metal having a low melting point is used together as in an exemplary embodiment of the present invention, the alkali metal blocks atom transfer, so that particle separation becomes easy. Accordingly, the magnetic powder may be produced into fine particles.

That is, when the alkali metal is added, the size of powder particles is decreased, spherical particles may be formed, and it is possible to produce spherical particles having a powder size of 1 to 2 μm.

Here, a content of the alkali metal may be 1 wt % to 20 wt %. Preferably, when the content is 3 wt % to 7 wt %, shape and agglomeration are controlled well. When the content of the alkali metal is less than 1 wt %, shape and agglomeration may not be controlled well, and when the content is 20 wt % or more, vapor of the alkali metal occurs in the process and treatment before and after the process may be difficult.

A carbon sheet is placed on the third mixture, silica sand ($SiO_2$ sand) is placed thereon, and the mixture is heated at a temperature of 800° C. to 1100° C. Alkali metal vapor is adsorbed (captured) by the use of silica sand and contamination of process equipment with the alkali metal may be controlled.

The step of heating the mixture to a temperature of 800° C. to 1100° C. may be performed for 10 minutes to 6 hours under an inert gas atmosphere. When a heating time is 10 minutes or less, the metal powder is not sufficiently synthesized, and when a heating time is 6 hours or more, a metal powder size becomes coarse and agglomeration between primary particles may occur.

The thus-produced magnetic powder may be $Nd_2Fe_{14}B$. In addition, the size of the produced magnetic powder may be 0.5 μm to 10 μm. In addition, the size of the magnetic powder produced according to an exemplary embodiment may be 0.5 μm to 5 μm. In addition, the thus-produced magnetic powder includes anisotropic crystal grains.

Accordingly, when the magnetic powder is sintered, magnetic crystal anisotropy of the sintered magnet may be optimized.

Usually, in order to form a $Nd_2Fe_{14}B$ alloy powder, raw materials are melted at a high temperature of 1500° C. to 2000° C. and then quenched to form a raw material mass, and the mass are subjected to coarse grinding, hydrogen crushing, and the like to obtain a $Nd_2Fe_{14}B$ alloy powder.

However, this method requires a high temperature for melting the raw materials and a process of cooling and grinding the raw materials again, and thus, a process time is long and the process is complicated.

However, when the NdFeB-based powder is produced by the reduction-diffusion method as in the present exemplary embodiment, the $Nd_2Fe_{14}B$ alloy powder is formed by reduction and diffusion of the raw materials at a temperature of 800° C. to 1100° C. In this step, since the size of the alloy powder is formed in a unit of several micrometers, a separate grinding process is not needed. More specifically, the size of the magnetic powder produced in the present exemplary embodiment may be 0.5 μm to 10 μm. Particularly, the size of the alloy powder may be adjusted by adjusting the size of an iron powder used as the raw material.

In addition, since the alkali metal is included in the production process, formation of anisotropic crystal grains of the magnetic powder is induced by the alkali metal. Accordingly, magnetic crystal anisotropy of the sintered magnet may be optimized.

Then, hereinafter, the magnetic powder according to an exemplary embodiment will be described. The magnetic powder according to the present exemplary embodiment may be produced by the produced method described above. In addition, the magnetic powder according to the present exemplary embodiment may include $Nd_2Fe_{14}B$, have a size of 0.5 μm to 10 μm, and include anisotropic crystal grains.

Then, hereinafter, the method for producing a magnetic powder according to the present disclosure will be described by the specific examples.

EXAMPLE 1

Addition of Li

To a sample in which 6.8682 g of $Nd_2O_3$, 0.2101 g of B, and 13.6742 g of Fe were uniformly mixed using a ball-mill and a paint shaker, 3.6742 g of Ca was further added and the materials were remixed using a Turbula mixer. The mixture was placed in a SUS tube having an optional shape, 0.1416 g of Li was added to the mixture, a carbon sheet was placed on the tapped mixture, silica sand ($SiO_2$ sand) was placed thereon, and the reaction was performed in a tube electric furnace at 920° C. for 1 hour under an inert gas (Ar, He) atmosphere. After the reaction is completed, the sample was ground to form a powder, CaO which is a byproduct was removed using a $NH_4NO_3$-MeOH solution (or a $NH_4Cl$-MeOH solution, $NH_4Ac$-MeOH solution), and the powder was washed with acetone to finish a primary cleaning process and then vacuum dried. Thereafter, 0.2 g of $SbF_3$ was dissolved in methanol to form a solution, which was placed in a vessel having an optional shape together with the synthesized powder, a balls for a ball mill was added to the vessel to grind the powder using a Turbula mixer, and the powder was secondarily cleaned with methanol and washed with acetone, and vacuum dried.

EXAMPLE 2

Addition of Na

To a sample in which 6.8682 g of $Nd_2O_3$, 0.2101 g of B, and 13.6742 g of Fe were uniformly mixed using a paint shaker, 3.6742 g of Ca was further added, and the materials were remixed using a Turbula mixer. The mixture was placed in a SUS tube, 0.4691 g of Na was added to the mixture, and the mixture was tapped, reacted as presented in Example 1), and subjected to post-treatment.

EXAMPLE 3

Addition of NaK Mixture

To a sample in which 6.8682 g of $Nd_2O_3$, 0.2101 g of B, and 13.6742 g of Fe were uniformly mixed using a paint shaker, a powder in which 0.7230 g of NaK and 3.6742 g of Ca were mixed was further added, and the materials were remixed using a paint shaker again. The mixture was placed in SUS, tapped, reacted by the method presented in Example 1), and subjected to post-treatment. NaK used in the present exemplary embodiment is an alloy of Na:K=20:80 and is in a liquid state at room temperature, and thus, uniform mixing is possible.

EXAMPLE 4

Addition of $CaF_2$+Li

To a sample in which 6.8682 g of $Nd_2O_3$, 0.2101 g of B, 13.6742 g of Fe, and 0.3035 g of $CaF_2$ were uniformly mixed using a paint shaker, 3.6742 g of Ca was further added, and the materials were remixed using a Turbula mixer. The mixture was placed in a SUS tube, 0.1416 g of Li was added to the mixture, and the mixture was tapped, reacted by the method presented in Example 1), and subjected to post-treatment.

EXAMPLE 5

Addition of $CaF_2$+Na

To a sample in which 6.8682 g of $Nd_2O_3$, 0.2101 g of B, 13.6742 g of Fe, and 0.3035 g of $CaF_2$ were uniformly mixed using a paint shaker, 3.6742 g of Ca was further added, and the materials were remixed using a Turbula mixer. The mixture was placed in a SUS tube, 0.4691 g of Na was added to the mixture, and the mixture was tapped, reacted by the method presented in Example 1), and subjected to post-treatment.

EXAMPLE 6

Addition of $CaF_2$+NaK Mixture

To a sample in which 6.8682 g of $Nd_2O_3$, 0.2101 g of B, 13.6742 g of Fe, and 0.3035 g of $CaF_2$ were uniformly mixed using a paint shaker, a powder in which 0.7230 g of NaK and 3.6742 g of Ca were mixed was further added, and the materials were remixed using a paint shaker again. The mixture was placed in a SUS tube, tapped, reacted by the method presented in Example 1), and subjected to post-treatment.

EXAMPLE 7

Addition of LiF+NaK Mixture

To a sample in which 6.8682 g of $Nd_2O_3$, 0.2101 g of B, 13.6742 g of Fe, and 0.2065 g of LiF were uniformly mixed using a paint shaker, a powder in which 0.7230 g of NaK and 3.6742 g of Ca were mixed was further added, and the materials were remixed using a paint shaker again. The mixture was placed in a SUS tube, tapped, reacted by the method presented in Example 1), and subjected to post-treatment.

EXAMPLE 8

Addition of Al+NaK Mixture+Sintering ($NdH_2$)

To a sample in which 6.8682 g of $Nd_2O_3$, 0.2101 g of B, 13.6742 g of Fe, 0.0617 g of Cu, and 0.042 g of Al were uniformly mixed using a paint shaker, a powder in which 0.7230 g of NaK and 3.6742 g of Ca were mixed was further added, and the materials were remixed using a paint shaker again. The mixture was placed in a SUS tube, tapped, reacted by the method presented in Example 1), and primarily cleaned. Thereafter, the powder was added to a $NH_4NO_3$-MeOH solution, ground-cleaned using a Turbula mixer, secondarily cleaned with methanol, washed with acetone, and vacuum dried. 8 g of $NdFeBCu_{0.05}Al_{0.08}$ powder particles and a $NdH_2$ powder of a mass ratio of 12% were mixed, butanol as a lubricant was added thereto, and the mixture was molded in a magnetic field and then sintered at 1040° C. for 2 hours using a vacuum sintering furnace.

COMPARATIVE EXAMPLE 1

No Addition of Alkali Metal

Figure 7:
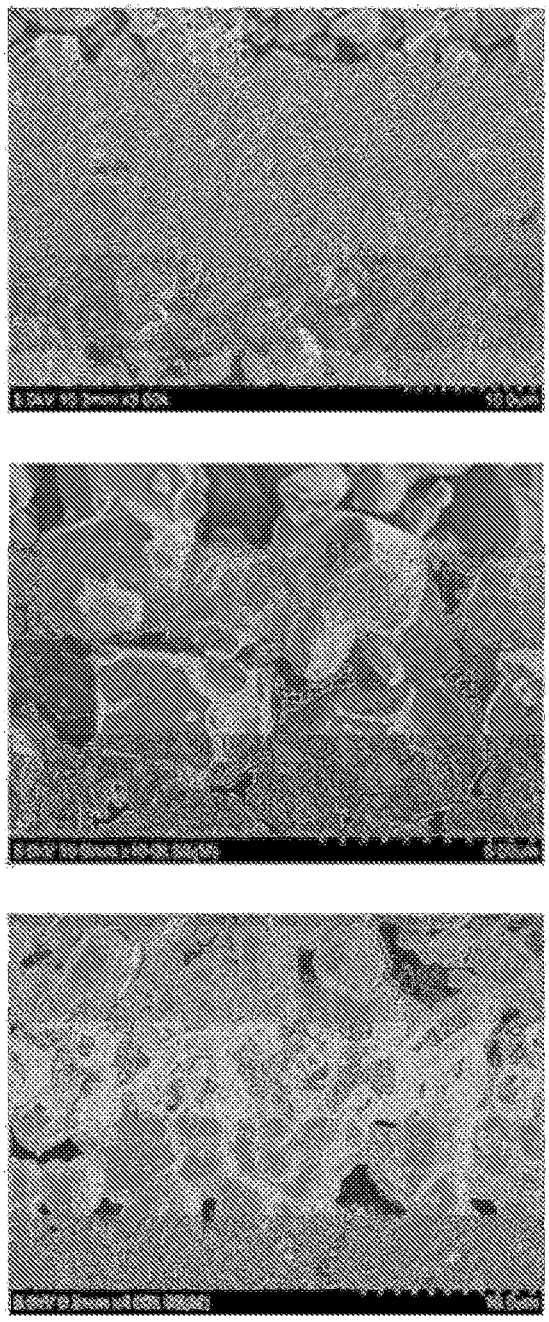
FIG. 7 is scanning electron microscope images of a magnetic powder produced in Comparative Example 1.

To a sample in which 6.8682 g of $Nd_2O_3$, 0.2101 g of B, and 13.6742 g of Fe were uniformly mixed using a paint shaker, 3.6742 g of Ca was further added, and the materials were remixed using a Turbula mixer. The mixture was placed in a SUS tube, tapped, reacted by the method presented by Example 1), and subjected to post-treatment. The scanning electron microscope image of the magnetic powder produced in Comparative Example 1 is illustrated in FIG. 7.

EXAMPLE 9

Sintering of Powder Produced in Example 3

The powder produced in Example 3) was used to orient 3 g of the powder and sintered at 1040 C for 2 hours using a vacuum sintering furnace.

COMPARATIVE EXAMPLE 2

Sintering of Powder Produced in Comparative Example 1

The powder produced in Comparative Example 1) was used to orient 3 g of the powder and sintered at 1040 C for 2 hours using a vacuum sintering furnace.

EVALUATION EXAMPLE 1

XRD Pattern

XRD patterns of the magnetic powders produced in Examples 1 to 7 are shown in FIG. 1. FIG. 1 shows that a $Nd_2Fe_{14}B$ main phase was formed well.

EVALUATION EXAMPLE 2

Magnetic Hysteresis Loop Data

Figure 2:
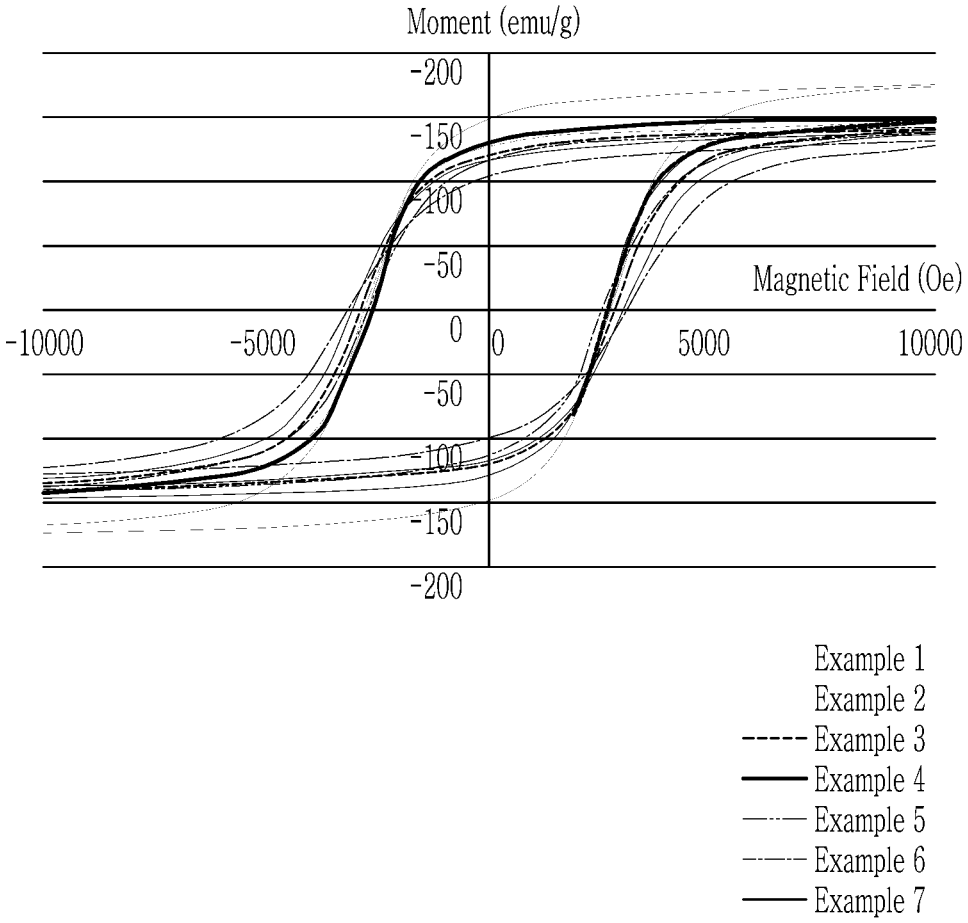
FIG. 2 shows magnetization hysteresis loops of magnetic powders produced in Examples 1 to 7.
Figure 3:
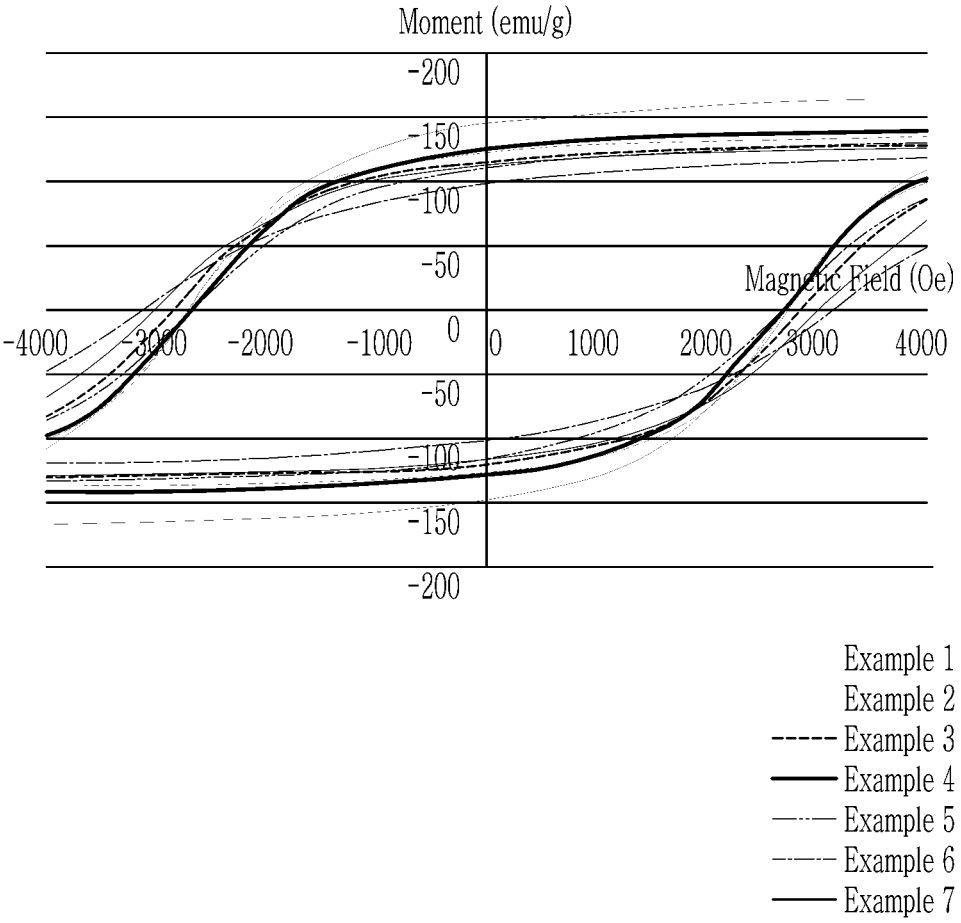
FIG. 3 shows magnetization hysteresis loops of magnetic powders produced in Examples 1 to 7.

Magnetic hysteresis loops of the magnetic powders produced in Examples 1 to 7 are shown in FIG. 2, and the partially enlarged magnetic hysteresis loops of FIG. 2 are shown in FIG. 3. The magnetic hysteresis loop of the resulting magnetic powder may be confirmed from the results.

EVALUATION EXAMPLE 3

Scanning Electron Microscope Image

Figure 4:
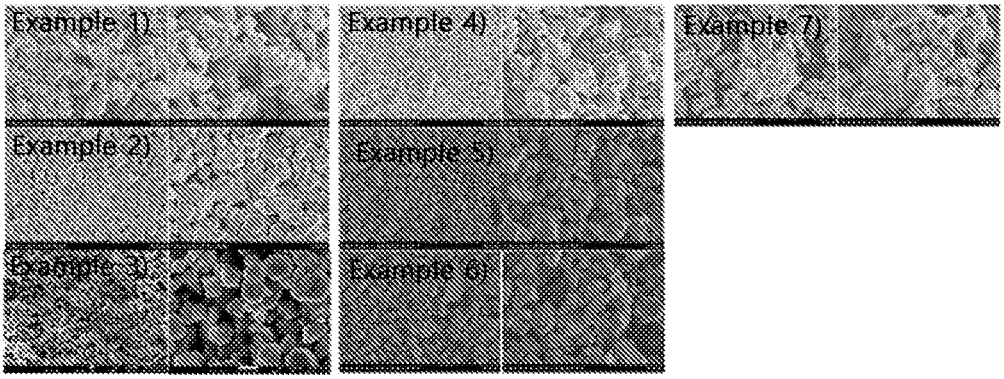
FIG. 4 is scanning electron microscope images of magnetic powders produced in Examples 1 to 7.

Scanning electron microscope images of the magnetic powders produced in Examples 1 to 7 are shown in FIG. 4. It was confirmed from the results that the produced magnetic powder had an anisotropic shape and a size in a micro level.

EVALUATION EXAMPLE 4

PSA Data

Figure 5:
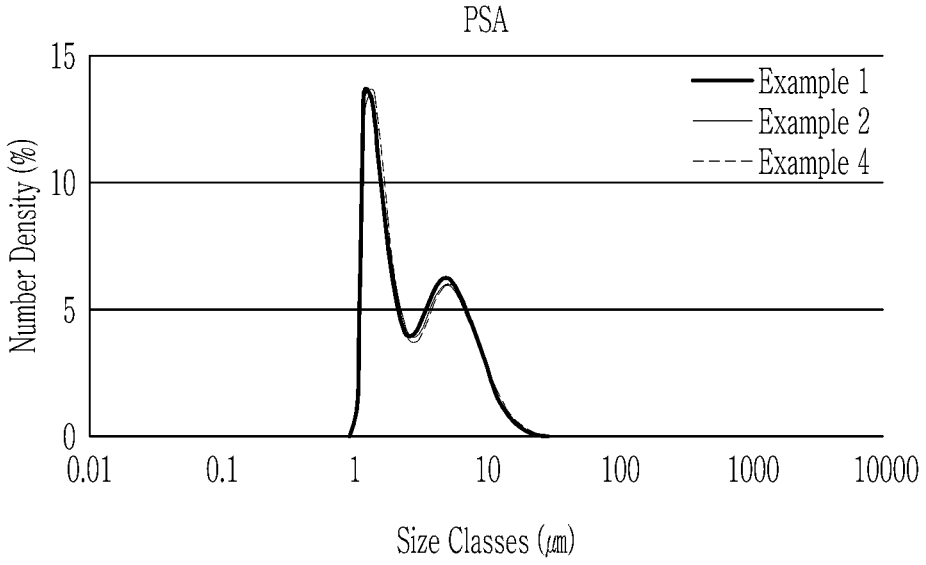
FIG. 5 is particle size analysis (PSA) data of magnetic powders produced in Examples 1, 2, and 4.

PSA data of the magnetic powders produced in Examples 1, 2, and 4 is shown in FIG. 5. The size distribution of the produced magnetic powder may be confirmed from the results.

EVALUATION EXAMPLE 5

B—H Data

Figure 6:
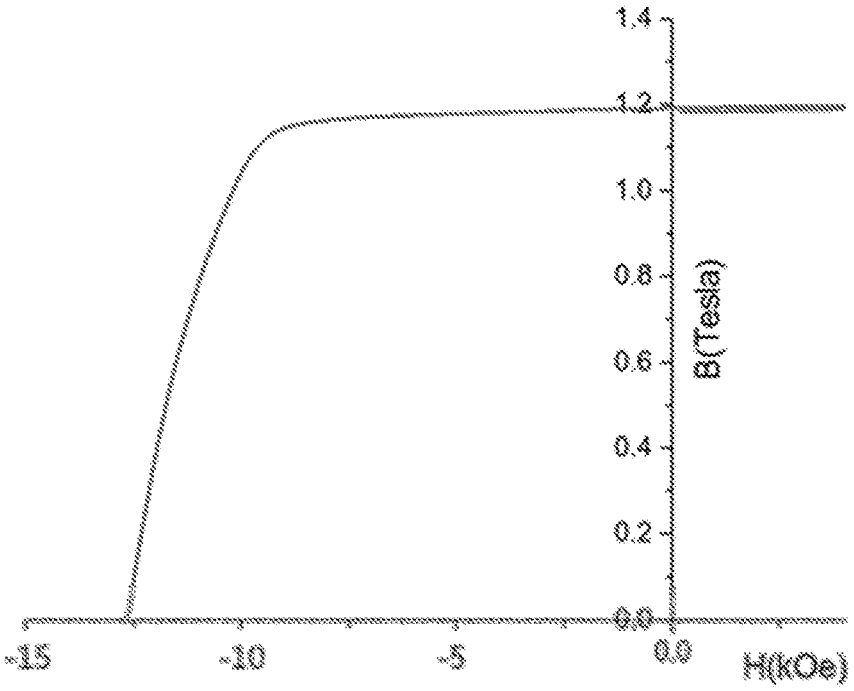
FIG. 6 shows the results of measuring B—H of a sintered magnet produced in Example 8.

B—H of the sintered magnet produced in Example 8 was measured and the results are shown in FIG. 6. The magnetic characteristics of the produced sintered magnet may be confirmed from the results.

EVALUATION EXAMPLE 6

B—H Data

Figure 8:
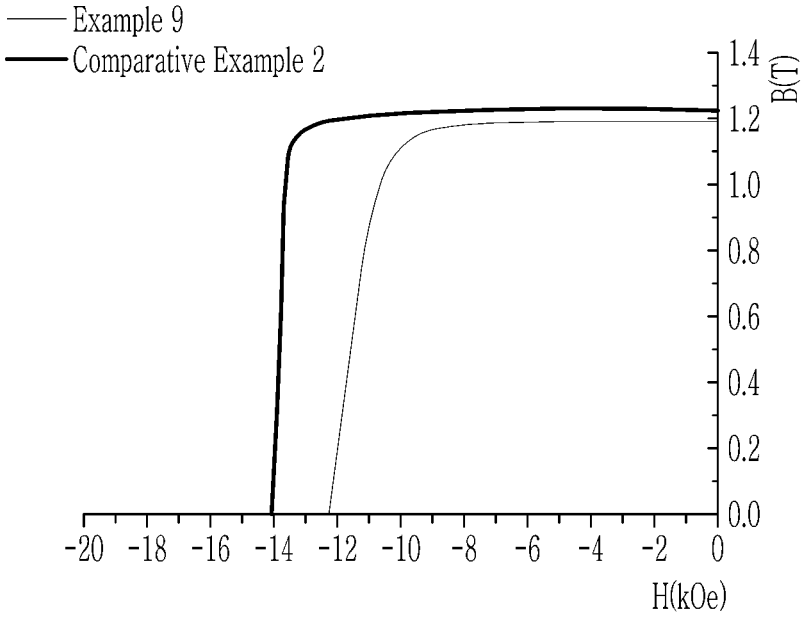
FIG. 8 shows the results of measuring B—H of a sintered magnet produced in Comparative Example 2.

B—H of the sintered magnet produced in Example 9 was measured and the results are shown in FIG. 8. In addition, B—H of the sintered magnet produced in Comparative Example 2 was measured and the results are shown together in FIG. 8. It may be confirmed therefrom that the sintered magnet produced in Example 9 had more improved characteristics than the sintered magnet produced in Comparative Example 2.

While this invention has been described in connection with what is presently considered to be practical exemplary embodiments, it is to be understood that the invention is not limited to the disclosed embodiments. On the contrary, it is intended to cover various modifications and equivalent arrangements included within the spirit and scope of the appended claims.

The invention claimed is:

1. A method for producing a magnetic powder, comprising:

mixing neodymium oxide, boron, and iron to prepare a first mixture;

adding calcium to the first mixture and mixing to prepare a second mixture;

mixing an alkali metal with the second mixture to prepare a third mixture; and placing a carbon sheet on the third mixture, placing silica sand thereon, and then heating at a temperature of 800° C. to 1100° C.

2. The method for producing a magnetic powder of claim 1, wherein:

the alkali metal is one or more selected from the group consisting of Li, Na, K, Rb, and Cs.

3. The method for producing a magnetic powder of claim 1, wherein:

in the mixing of an alkali metal with the second mixture to prepare a third mixture, a content of the alkali metal is 1 wt % to 20 wt %.

4. The method for producing a magnetic powder of claim 1, wherein:

the produced magnetic powder is $Nd_2Fe_{14}B$.

5. The method for producing a magnetic powder of claim 1, wherein:

in the heating of the third mixture at temperature of 800° C. to 1100° C., a heating time is 10 minutes to 6 hours.

6. The method for producing a magnetic powder of claim 1, wherein:

in the mixing of neodymium oxide, boron, and iron to prepare a first mixture, the first mixture further includes a metal fluoride.

7. The method for producing a magnetic powder of claim 6, wherein:

the metal fluoride is one or more selected from the group consisting of fluorides of alkali metals, alkaline-earth metals, and transition metals.

8. The method for producing a magnetic powder of claim 7, wherein:

the metal fluoride includes one or more metal fluorides selected from the group consisting of $CaF_2$, LiF, $AlF_3$, $CoF_2$, $CuF_2$, $CrF_3$, $FeF_2$, $NiF_2$, $GaF_3$, and $ZrF_4$.

9. The method for producing a magnetic powder of claim 1, wherein:

in the mixing of the neodymium oxide, the boron, and the iron to prepare the first mixture, one or more selected from the group consisting of Group 1 elements, Group 2 elements, and transition metals are further included.

10. The method for producing a magnetic powder of claim 1, wherein:

the produced magnetic powder includes anisotropic crystal grains.

* * * * *